US007749031B2

(12) United States Patent
Detter et al.

(10) Patent No.: US 7,749,031 B2
(45) Date of Patent: Jul. 6, 2010

(54) LEVER LOCK BATTERY CLAMP TERMINAL

(75) Inventors: Gary C. Detter, Berlin Center, OH (US); Jay Harold Garretson, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 140 days.

(21) Appl. No.: 12/080,451

(22) Filed: Apr. 3, 2008

(65) Prior Publication Data

US 2009/0253312 A1 Oct. 8, 2009

(51) Int. Cl.
*H01R 4/50* (2006.01)

(52) U.S. Cl. ..... 439/773; 439/772

(58) Field of Classification Search ..... 439/773, 439/772, 761–764
See application file for complete search history.

(56) References Cited

U.S. PATENT DOCUMENTS 3,568,138 A 3/1971 Bakker et al.
4,054,355 A 10/1977 Kourimsky et al.
5,254,020 A * 10/1993 Obligar ..... 439/761
5,595,510 A * 1/1997 Obligar ..... 439/761
7,166,001 B2 1/2007 Detter et al.
7,189,122 B2 3/2007 Freitag
2005/0153201 A1 7/2005 Nakazawa

* cited by examiner

*Primary Examiner*—Gary F. Paumen
(74) *Attorney, Agent, or Firm*—Thomas N. Twomey

(57) ABSTRACT

A battery clamp includes a collar cooperating with opposing compression plates to engage a battery terminal. The clamp further includes a locking mechanism adapted to apply a compression force between the collar and the battery terminal. A method of securing a battery clamp to a terminal includes positioning a clamp around a terminal of a battery, wherein the clamp includes a collar and opposing compression plates. The method further includes engaging the collar to the terminal of the battery by applying a force to the compression plates.

6 Claims, 4 Drawing Sheets

LEVER LOCK BATTERY CLAMP TERMINAL

FIELD

The present embodiments generally relate to battery clamps used to connect battery terminals to electrical connectors of a machine.

BACKGROUND

Batteries are used in a wide variety of applications ranging from handheld devices and small electronics to automobiles and large industrial machinery (collectively "devices"). The devices are generally connected to positive and negative battery terminals (often referred to as battery posts) through an electrical conductor such as a wire or coax cable. The electrical conductor is often secured to the battery posts using some type of battery clamp assembly that establishes a firm electrical connection between the battery post and a terminal end of the electrical conductor. The quality of the electrical connection between the battery and the device is often dependent on the quality and durability of the battery clamp assembly.

In many applications, the terminal connection to the battery post is accomplished using a horizontal bolt and trapped nut combination. This type of clamp assembly is generally difficult to assemble, particularly when the battery is located in close proximity to surrounding structures, which limits the space necessary to access and tighten the bolt. Further, batteries are often subject to vibration and environmental contaminants that can over time loosen the connection point between the battery posts and the clamp assemblies. Eventually, the clamp assembly may completely disengage from the battery post, terminating the electrical connection.

Accordingly, the embodiments described herein were developed in light of these and other drawbacks associated with known battery clamps.

SUMMARY

A battery clamp includes a collar cooperating with opposing compression plates to engage a battery terminal. The clamp further includes a locking mechanism adapted to apply a compression force between the collar and the battery terminal.

A method of securing a battery clamp to a terminal includes positioning a clamp around a terminal of a battery, wherein the clamp includes a collar and opposing compression plates. The method further includes engaging the collar to the terminal of the battery by applying a force to the compression plates.

BRIEF DESCRIPTION OF THE DRAWINGS

The foregoing brief description will be understood more completely from the following detailed description of the exemplary drawings, in which.

DETAILED DESCRIPTION

A battery clamp assembly includes a collar and opposing compression plates that cooperate with a locking mechanism to engage a battery post terminal along an axis generally parallel to side walls of the battery post. In one embodiment, the locking mechanism includes a pivotable lever and clip combination that is tightened to a lock position and accessible along the parallel axis. The pivotal lever and clip combination is configured to cooperate with the compression plates such that the resulting clamping pressure is transferred to a gripping force around the battery post, perpendicular to the parallel axis. The gripping force of the collar onto the side walls of the battery post terminal provides a constant and tight contact pressure that establishes a firm electrical connection between the battery clamp and the battery post terminal.

Figure 1:
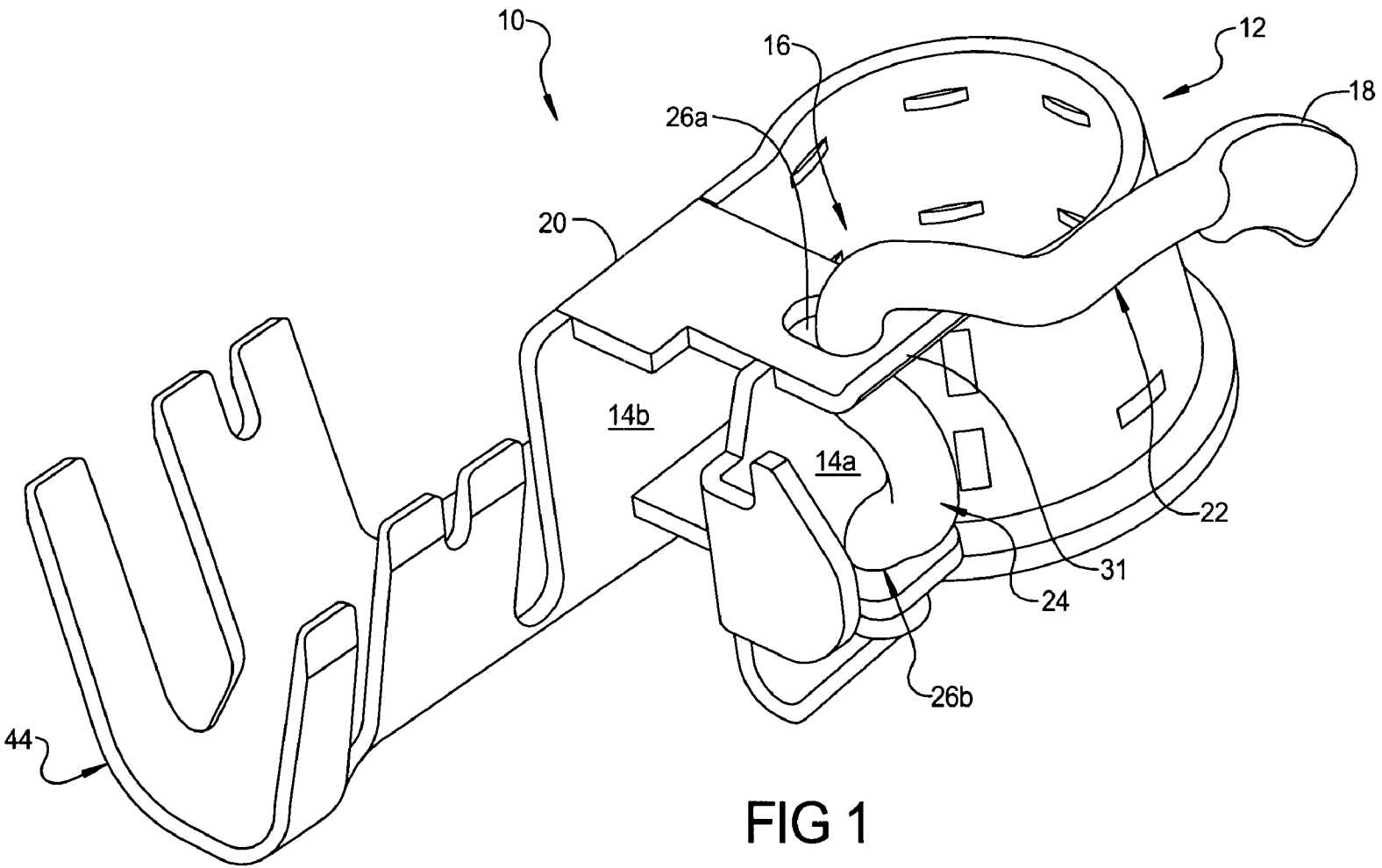
FIG. 1 is a perspective view of an exemplary battery clamp assembly in an unlocked position.
Figure 2:
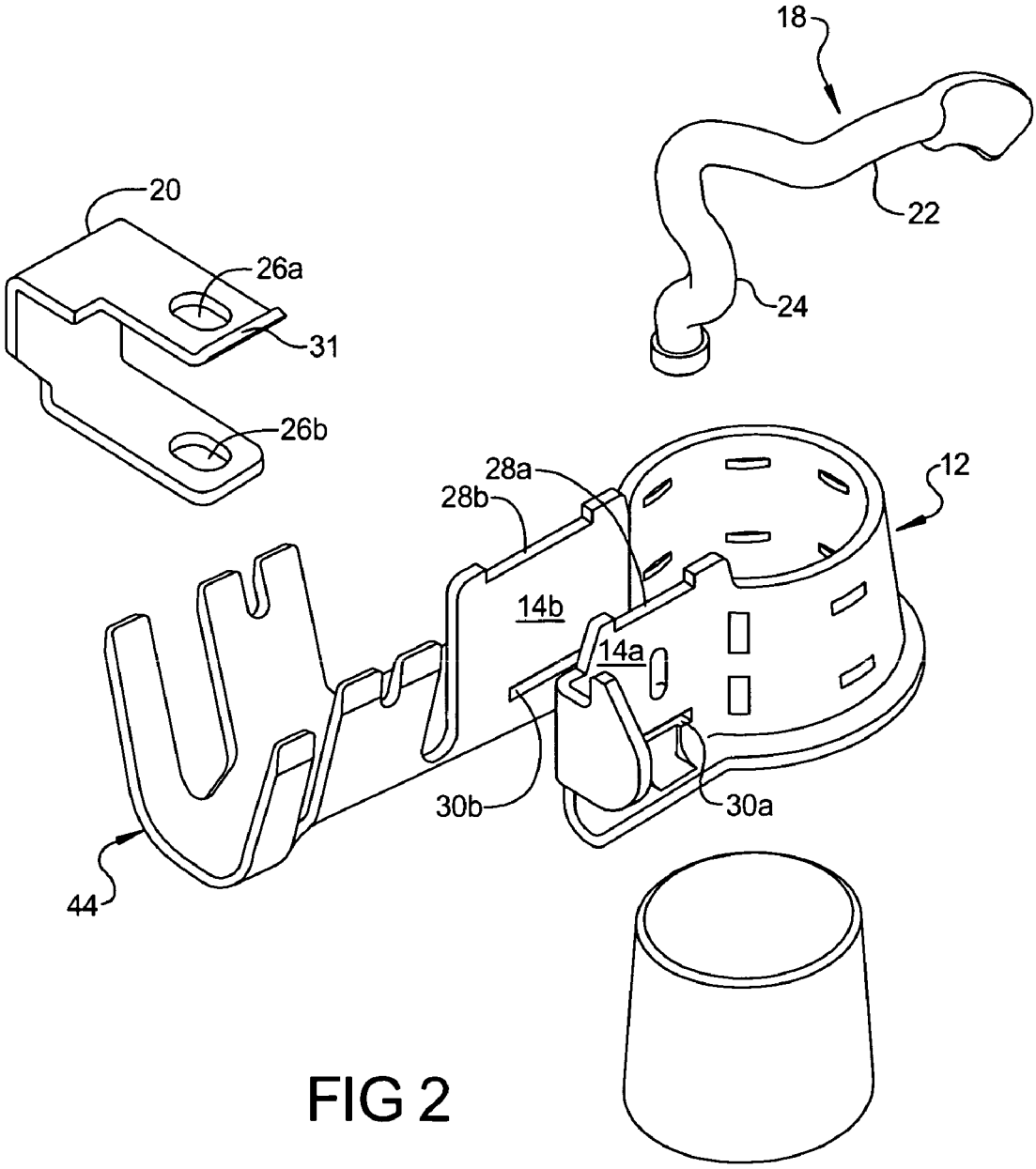
FIG. 2 is an exploded view of the individual components of the battery clamp of FIG. 1.

FIG. 1 illustrates an exemplary battery clamp assembly 10 having a collar portion 12 and opposing compression plates 14*a*, 14*b* that cooperate with a locking mechanism 16 to engage a battery post terminal. The locking mechanism 16 includes a pivotable lever 18 and clip 20 combination that cooperate to apply a compression force between the collar portion 12 of the battery clamp 10 and the battery terminal. One of ordinary skill in the art understands that the locking mechanism 16 described above is exemplary and that the specific shape, configuration and orientation of the lever 18 and clip 20 may vary. The lever 18 has a horizontal handle-like portion 22 and a curved, serpentine-like vertical portion 24 that threads through top and bottom apertures 26*a*, 26*b* of clip 20. As best shown in FIG. 2, clip 20 in this embodiment is a c-style clip receivable by upper recesses 28*a*, 28*b* and slots 30*a*, 30*b* in compression plates 14*a*, 14*b*. The clip 20 further includes a bent-up tab or lip 31 on a distal end of clip 20 adjacent aperture 26*a*. In this way, the horizontal portion 22 of the lever 18 rests against the lip 31 and is held in place when the locking mechanism 16 is in an unlocked position, as shown in FIG. 1.

Figure 3:
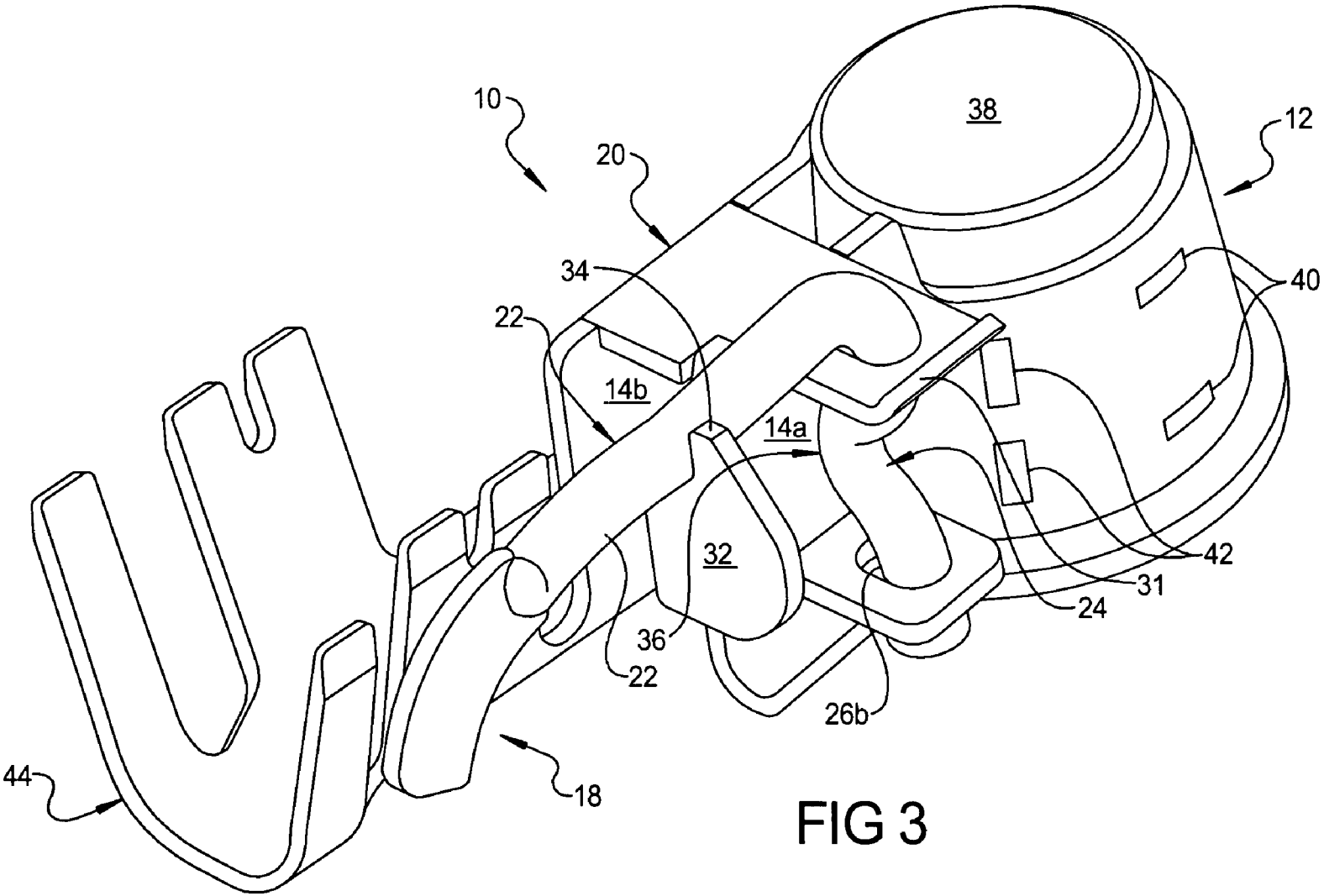
FIG. 3 is a perspective view of the exemplary battery clamp assembly of FIG. 1 mounted to a battery post in a locked position.

To reach a locked position as shown in FIG. 3, lever 18 pivots in a horizontal direction approximately 180 degrees about a vertical axis until it engages a locking tab 32. In one embodiment, the locking tab 32 extends generally perpendicular from compression plate 14*a* and includes a hook-like protrusion 34 that allows the horizontal portion 22 of the lever 18 to "snap" into place behind the locking tab 32 to secure the lever 18 in the locked position. As the lever 18 is rotated toward the locked position, an outermost curve 36 of lever 18 presses against an outer surface of compression plate 14*a*. The resulting force applied against compression plate 14*a* tightens the collar portion 12 onto the battery post terminal 38. In other words, the clamping pressure applied to the compression plates 14*a*, 14*b* is transferred to a gripping force around the battery post 38, perpendicular to the parallel axis. In addition, one of ordinary skill in the art understands that the diameter of the collar portion 12 as well as the height of the collar 12 is not limited to the embodiment shown in FIGS. 1-3. For example, in one exemplary embodiment, the collar 12 may surround approximately seventy-five to eighty percent of the side wall surface area of the post terminal 38, but may encompass more or less, depending on the application. In general, however, the collar portion 12 is shaped to substantially match the contours of the post terminal 38 to promote steady surface contact. It is further contemplated that the collar portion 12 may be adapted to fit around varying shapes and sizes of different battery terminals depending on the make and manufacturer of the battery. For example, the collar 12 may extend higher or lower on the terminal 38 than depicted in FIG. 2.

As shown in each of FIGS. 1, 2 and 3, the collar portion 12 may include a plurality of horizontal and vertical teeth 40, 42, respectively. The teeth 40, 42 are textured portions of the collar portion 12 that are integrally formed in the walls of collar portion 12. The teeth 40, 42 secure the collar 12 against the walls of the battery post terminal 38 by embedding into the post 38 providing additional gripping force when the locking mechanism 16 is tightened. As the horizontal teeth 40 are tightened against the post 38, they prevent the clamp 10 from loosening in a vertical direction. The vertical teeth 42 also embed into the post 38 upon tightening, preventing rotation of the clamp 10 in a horizontal direction. In one embodiment, the vertical teeth 42 are positioned to oppose the horizontal teeth 40 to enhance the gripping strength of the clamp 10. In this way, the teeth 40, 42 break into the post surface providing an air tight/gas free, electrical contact in the post. It is contemplated that the teeth 40, 42 can vary in length and width according to the size of the collar 12 and the post terminal 38. It is also contemplated that the texture of the teeth 40, 42 may vary to adapt to any number of battery terminal surfaces, if necessary. In other words, the number and position of the teeth 40, 42 are not limited to the exemplary embodiments of FIGS. 1, 2 and 3.

Figure 4:
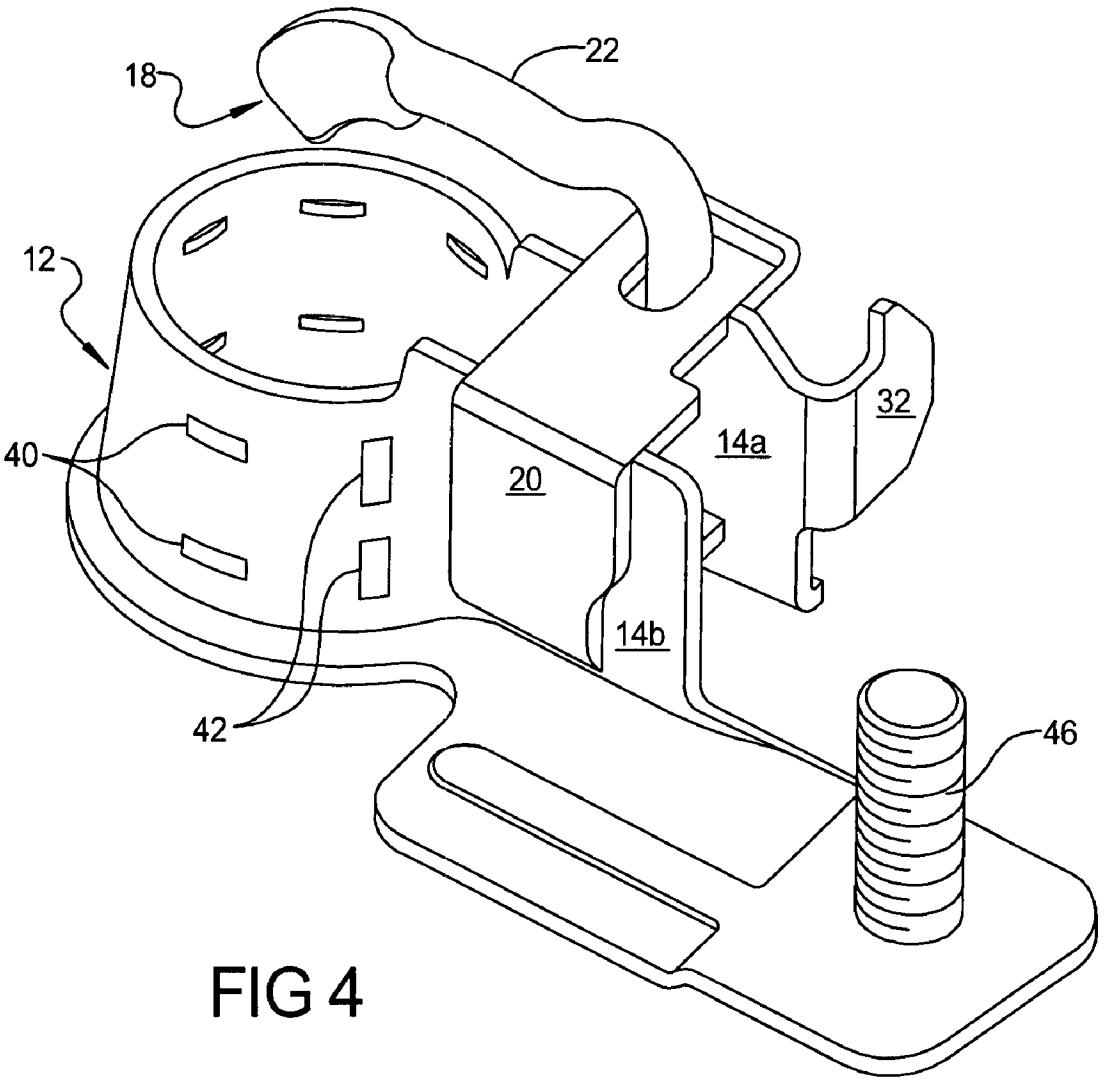
FIG. 4 is a perspective view of alternative battery clamp assemblies according to an embodiment.

Extending from compression plate 14*b*, opposite collar portion 12, is a crimping claw 44. The crimping claw 44 is generally integrally formed with collar portion 12 and has a U-shaped channel formation, as depicted in FIGS. 1-3. The U-shaped crimping claw 44 has sides that are uneven in length and that have notches at the edges as illustrated. The crimping claw 44 is adapted to receive and support any electrical connectors such as, for example, wires and cables. The sides of the crimping claw 44 may be folded over onto each other and over the connectors being supported by the crimping claw 44, further securing the connectors into place and facilitating a steady and constant electrical connection between the post terminal 38 and an electrical component. Again as appreciated by those skilled in the art, the crimping claw 44 may be of any design, depth, or width without deviating from the scope of the subject invention. For example, FIG. 4 illustrates an alternative ring terminal style configuration of battery clamp 10. This ring terminal style clamps to the battery post 38 in the same manner as clamp assembly 10 in FIGS. 1, 2 and 3, except this type has an alternative method as to which it can be connected to an electrical connection rather than the crimping claws. The threaded stud will allow various other styles of electrical connections to be mounted over the stud and clamp onto the stud with a nut, thus providing the completed electrical connector. In essence, this embodiment is configured to accept a ring terminal (terminated to a battery cable) placed over a bolt 46, and is held in place with a nut (not shown).

The appended claims have been particularly shown and described with reference to the foregoing embodiments, which are merely illustrative of the best modes for carrying out the invention defined by the appended claims. It should be understood by those skilled in the art that various alternatives to the embodiments described herein may be employed in practicing the invention defined by the appended claims without departing from the spirit and scope of the invention as defined in claims. The embodiments should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

With regard to the processes, methods, heuristics, etc. described herein, it should be understood that although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes described herein are provided for illustrating certain embodiments and should in no way be construed to limit the appended claims.

Accordingly, it is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary is made herein. In particular, use of the singular articles such as "a," "the," "said," etc. should be read to recite one or more of the indicated elements unless a claim recites an explicit limitation to the contrary.

What is claimed is:

1. A battery clamp, comprising:

a collar cooperating with opposing compression plates to engage a battery terminal;

a locking mechanism adapted to apply a compression force between said collar and said battery terminal, and said locking mechanism includes a clip and lever combination; and wherein said clip includes a lip positioned at a distal end of said clip and configured to secure said clip to said compression plates when said lever is in an unlocked position.

2. A battery clamp, comprising:

a collar cooperating with opposing compression plates to engage a battery terminal;

a locking mechanism adapted to apply a compression force between said collar and said battery terminal, and said locking mechanism includes a clip and lever combination; and wherein said lever includes a horizontal portion and a vertical portion, said vertical portion being threaded through apertures in said clip.

3. The battery clamp of claim 2, wherein said lever is pivotable about said clip through said apertures.

4. The battery clamp of claim 2, wherein said vertical portion of said lever has a serpentine-like configuration with an outermost curve that applies a force to said compression plates as said lever pivots about said clip from an unlocked to a locked position.

5. A battery clamp, comprising:

a collar cooperating with opposing compression plates to engage a battery terminal;

a locking mechanism adapted to apply a compression force between said collar and said battery terminal, and said locking mechanism includes a clip and lever combination; and a locking tab with a hook-like protrusion configured to engage said lever when in a locked position.

6. The battery clamp of claim 5, wherein said locking tab extends perpendicularly from at least one of said compression plates.

* * * * *